US010492547B2

(12) United States Patent
Weber et al.

(10) Patent No.: US 10,492,547 B2
(45) Date of Patent: Dec. 3, 2019

(54) METHOD AND SYSTEM FOR INTRODUCING A RESERVE NOSE WIRE IN A FACEMASK PRODUCTION LINE

(71) Applicant: O&M Halyard, Inc., Mechanicsville, VA (US)

(72) Inventors: Joseph P. Weber, Suwanee, GA (US); Ajay Y. Houde, Duluth, GA (US); David Lamar Harrington, Cumming, GA (US); Mark Thomas Pamperin, Cumming, GA (US); Nathan Craig Harris, Canton, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 0 days.

(21) Appl. No.: 15/307,398

(22) PCT Filed: Oct. 16, 2015

(86) PCT No.: PCT/US2015/055863
§ 371 (c)(1),
(2) Date: Oct. 28, 2016

(87) PCT Pub. No.: WO2017/065785
PCT Pub. Date: Apr. 20, 2017

(65) Prior Publication Data
US 2018/0206562 A1 Jul. 26, 2018

(51) Int. Cl.
*A41D 13/11* (2006.01)
*B65H 67/02* (2006.01)
*B65H 63/08* (2006.01)

(52) U.S. Cl.
CPC ..... *A41D 13/11* (2013.01); *B65H 63/082* (2013.01); *B65H 67/02* (2013.01); *Y10T 83/2083* (2015.04);
(Continued)

(58) Field of Classification Search
CPC ..... Y10T 83/902; Y10T 83/4705; Y10T 83/2083; Y10T 83/2085; Y10T 83/2087;
(Continued)

(56) References Cited

U.S. PATENT DOCUMENTS 2,414,772 A * 1/1947 Sheperdson ..... B23D 25/12 83/106
3,670,474 A 6/1972 Vieson et al.
(Continued)

FOREIGN PATENT DOCUMENTS

CA 2 325 975 A1 5/2002
CN 104872866 A 9/2015
(Continued)

OTHER PUBLICATIONS

International Search Report and Written Opinion, dated Jun. 2, 2016, 11 pages.

*Primary Examiner* — Laura M Lee
(74) *Attorney, Agent, or Firm* — Dority & Manning, P.A.

(57) ABSTRACT

A method and associated method are provided or introducing a supply of reserve nose wires in a facemask production line prior to depletion of running nose wires in the production line. A first nose wire source and first cutter system are provided for supplying the running nose wires to the production line. A reserve nose wire source and second cutter system are staged in a stand-by state proximate to the first nose wire source. Prior to depletion of the first nose wire source, the reserve nose wire source and second cutter system are brought up to an operational speed while diverting nose wires from the second cutter system away from the production line. At operational speed of the reserve nose wire source and second cutter system, nose wires from the
(Continued)

second cutter system are diverted to the production line while diverting nose wires from the first cutter system away from the production line.

11 Claims, 5 Drawing Sheets

(52) U.S. Cl.
CPC ..... *Y10T 83/2085* (2015.04); *Y10T 83/2087* (2015.04); *Y10T 83/902* (2015.04)

(58) Field of Classification Search
CPC . Y10T 225/237; A41D 13/11; A41D 13/1123; B65H 63/082; B65H 67/02; B65H 19/10; B65H 19/102
USPC ..... 83/650, 949, 950, 303; 242/553, 242/557–560.3, 562; 225/34–38
See application file for complete search history.

(56) References Cited

U.S. PATENT DOCUMENTS 3,834,260 A * 9/1974 Sieurin ..... B21B 39/18 83/106
3,847,046 A * 11/1974 Schmermund ..... B65H 5/26 83/152
3,871,257 A * 3/1975 Schmermund ..... B26D 1/385 83/285
3,983,774 A * 10/1976 Seragnoli ..... B65B 41/16 83/289
4,437,600 A * 3/1984 Storr ..... B21F 23/00 226/108
4,541,221 A * 9/1985 Seragnoli ..... B65B 57/02 242/554
4,640,164 A * 2/1987 Pavlov ..... B23D 25/12 83/154
4,694,714 A * 9/1987 Focke ..... B65H 19/10 242/554.4
4,917,285 A * 4/1990 Shosie ..... B21C 1/02 228/13
4,966,060 A * 10/1990 Poloni ..... B21B 39/18 83/105
5,092,530 A * 3/1992 Noirot ..... H01F 41/09 242/437.2
5,117,614 A 6/1992 Johnsen
5,129,294 A * 7/1992 Boldrini ..... B65H 19/18 242/559.1
5,155,967 A 10/1992 Branson
5,170,610 A 12/1992 Tisma
5,297,751 A * 3/1994 Boldrini ..... B65H 19/1836 242/553
5,322,061 A 6/1994 Brunson
5,394,778 A * 3/1995 Sakowski ..... B65H 19/10 83/106
5,724,677 A 3/1998 Bryant et al.
5,727,369 A 3/1998 Mosse
6,038,951 A * 3/2000 Alfredo ..... B23D 33/02 83/105
6,082,237 A * 7/2000 Bollig ..... B23D 33/02 83/105
6,138,541 A * 10/2000 Krampitz ..... B21B 39/18 83/102
6,173,712 B1 1/2001 Brunson
6,174,397 B1 1/2001 Johnson
6,209,432 B1 * 4/2001 Matsuda ..... B23D 31/008 241/242
6,244,321 B1 * 6/2001 Sakamoto ..... B65H 19/1852 156/159
6,524,423 B1 2/2003 Hilt et al.
6,729,103 B1 5/2004 Hartness et al.
7,703,260 B1 4/2010 Watkins
7,784,516 B2 * 8/2010 Chen ..... A41D 13/11 128/206.28
10,227,202 B2 * 3/2019 Pamperin ..... A41D 13/11
2002/0078805 A1 * 6/2002 Hellenbrandt ..... B21C 47/34 83/13
2002/0095913 A1 7/2002 Honegger
2004/0144619 A1 7/2004 Ohiro et al.
2004/0262127 A1 12/2004 Harnish et al.
2005/0039584 A1 * 2/2005 Hellenbrandt ..... B21C 47/34 83/13
2006/0070353 A1 4/2006 Van Dam
2008/0072721 A1 * 3/2008 Kern ..... B21F 11/00 83/37
2008/0251210 A1 * 10/2008 Chen ..... A41D 13/11 156/356
2018/0206562 A1 * 7/2018 Weber ..... A41D 13/11
2019/0000162 A1 * 1/2019 Houde ..... A41D 13/11

FOREIGN PATENT DOCUMENTS

CN 104939377 A 9/2015
DE 3736868 A1 5/1989
EP 0 257 852 A2 3/1988
EP 0 622 298 A1 11/1994
EP 0 640 526 A1 3/1995
EP 0 791 537 A1 8/1997
EP 0 806 343 A2 11/1997
EP 0 894 752 A1 2/1999
EP 1 048 595 A1 11/2000
EP 1 840 033 A2 10/2007
EP 2 484 611 A2 8/2012
EP 2 801 790 A1 11/2014
FR 1588621 A 4/1970
GB 364557 12/1931
GB 1 232 053 5/1971
GB 2 092 090 A 8/1982
JP S 62103536 U 7/1987
JP 2011-178459 A 9/2011
KR 100550225 2/2006
WO WO 97/32494 9/1997

* cited by examiner

-Prior Art-

-Prior Art-

-Prior Art-

METHOD AND SYSTEM FOR INTRODUCING A RESERVE NOSE WIRE IN A FACEMASK PRODUCTION LINE

FAMILY OF RELATED APPLICATIONS

The present application is related by subject matter to the following concurrently filed PCT applications (all of which designate the US):

a. International Application No.: PCT/US2015/055861; entitled "Method and System for Splicing Nose Wire in a Facemask Manufacturing Process".
b. International Application No.: PCT/US2015/055858; entitled "Method and System for Splicing Nose Wire in a Facemask Manufacturing Process".
c. International Application No.: PCT/US2015/055865; entitled "Method and System for Cutting and Placing Nose Wires in a Facemask Manufacturing Process".
d. International Application No.: PCT/US2015/055867; entitled "Method and System for Placing Nose Wires in a Facemask Manufacturing Process".
e. International Application No.: PCT/US2015/055871; entitled "Method and System for Placing Nose Wires in a Facemask Manufacturing Process".
f. International Application No.: PCT/US2015/055872; entitled "Method and System for Placing Nose Wires in a Facemask Manufacturing Process".
g. International Application No.: PCT/US2015/055876; entitled "Method and System for Wrapping and Preparing Facemasks for Packaging in a Facemask Manufacturing Line".
h. International Application No.: PCT/US2015/055878; entitled "Method and System for Automated Stacking and Loading Wrapped Facemasks into a Carton in a Facemask Manufacturing Line".
i. International Application No.: PCT/US2015/055882; entitled "Method and System for Automated Stacking and Loading of Wrapped Facemasks into a Carton in a Facemask Manufacturing Line".

The above cited applications are incorporated herein by reference for all purposes. Any combination of the features and aspects of the subject matter described in the cited applications may be combined with embodiments of the present application to yield still further embodiments of the present invention.

FIELD OF THE INVENTION

The present invention relates generally to the field of protective facemasks, and more specifically to a method and system for supplying nose wires in the manufacturing of such facemasks.

BACKGROUND OF THE INVENTION

Various configurations of disposable filtering facemasks or respirators are known and may be referred to by various names, including "facemasks", "respirators", "filtering face respirators", and so forth. For purposes of this disclosure, such devices are referred to generically as "facemasks."

The ability to supply aid workers, rescue personnel, and the general populace with protective facemasks during times of natural disasters or other catastrophic events is crucial. For example, in the event of a pandemic, the use of facemasks that offer filtered breathing is a key aspect of the response and recovery to such event. For this reason, governments and other municipalities generally maintain a ready stockpile of the facemasks for immediate emergency use. However, the facemasks have a defined shelf life, and the stockpile must be continuously monitored for expiration and replenishing. This is an extremely expensive undertaking.

Recently, investigation has been initiated into whether or not it would be feasible to mass produce facemasks on an "as needed" basis during pandemics or other disasters instead of relying on stockpiles. For example, in 2013, the Biomedical Advanced Research and Development Authority (BARDA) within the Office of the Assistant Secretary for Preparedness and Response in the U.S. Department of Health and Human Services estimated that up to 100 million facemasks would be needed during a pandemic situation in the U.S., and proposed research into whether this demand could be met by mass production of from 1.5 to 2 million facemasks per day to avoid stockpiling. This translates to about 1,500 masks/minute. Current facemask production lines are capable of producing only about 100 masks/minute due to technology and equipment restraints, which falls far short of the estimated goal. Accordingly, advancements in the manufacturing and production processes will be needed if the goal of "on demand" facemasks during a pandemic is to become a reality.

The various configurations of filtration facemasks include a flexible, malleable metal piece, known as "nose wire", along the edge of the upper filtration panel to help conform the facemask to the user's nose and retain the facemask in place during use, as is well known. The nose wire may have a varying length and width between different sizes and mask configurations, but is generally cut from a spool and encapsulated or sealed in nonwoven material layers during the in-line manufacturing process. For mass production at the throughputs mentioned above, as the spool is depleted, it will be necessary to provide a reserve spool into the running line while maintaining the high production speeds of the running line.

The present invention addresses this need and provides a method and related system for high speed placement of reserve nose wires into an in-line manufacturing process of facemasks.

SUMMARY OF THE INVENTION

Objects and advantages of the invention will be set forth in the following description, or may be obvious from the description, or may be learned through practice of the invention.

In accordance with aspects of the invention, a method is provided for introducing a supply of reserve nose wires into a running facemask production line that does not necessitate a stoppage or slowdown of consequence in the production line. It should be appreciated that the present inventive method is not limited to any particular style or configuration of facemask that incorporates a nose wire, or to the downstream facemask production steps.

The method introduces a supply of reserve nose wires in the facemask production line prior to depletion of the running nose wires in the production line. The method includes providing a first nose wire source and a first cutter system for the production line, wherein the running nose wires are supplied by the first nose wire source and first cutter system. A reserve nose wire source and second cutter system are staged in a stand-by state proximate to the first nose wire source. Prior to depletion of the first nose wire source, the reserve nose wire source and second cutter system are brought up to an operational speed while nose wires produced by the second cutter system are diverted away from the production line, for example to a reject location. At a desired operational speed of the reserve nose wire source and second cutter system, nose wires from the second cutter system are diverted to the production line while nose wires from the first cutter system are diverted away from the production line, for example to the same or a different reject location.

After the nose wires from the first cutter system have been diverted away, the method may further include stopping and replacing the first nose wire source with a new nose wire source and placing the new nose wire source and first cutter system in a stand-by state proximate to the reserve nose wire source. Thus, the new nose wire source becomes the reserve nose wire source in a subsequent operation of the method.

In a particular embodiment, the first nose wire source and reserve nose wire source are rolls of nose wire that are rotationally driven at the operational speed to supply nose wire to their respective cutter system for the production line.

The method may include sensing one or a combination of speed of the reserve nose wire source or throughput of the second cutter system to determine when the reserve nose wire source and second cutter system are at operational speed.

In addition, a depletion state of the first nose wire source may be sensed for determining when to start bringing the reserve nose wire source and second cutter system up to the operation speed.

In a particular embodiment, the second cutter system and staging location for the reserve nose wire are permanent and fixed in the production line. In an alternate embodiment, the second cutter system and staging location for the reserve nose wire are portable and are moved to the production line at a sensed depletion state of the first nose wire source. Similarly, the first cutter system and location for the first nose wire source may be portable and moved between different production lines.

The present invention also encompasses various system embodiments for splicing a reserve nose wire to a running nose wire in a facemask production line in accordance with the present methods, as described and supported herein.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

As mentioned, the present methods relate to introducing a supply of reserve nose wires into the facemask production line prior to depletion of the running nose wires. The downstream facemask production steps are not limiting aspects of the invention and, thus, will not be explained in great detail herein.

Also, the present disclosure refers to or implies conveyance or transport of certain components of the facemasks through the production line. It should be readily appreciated that any manner and combination of article conveyors (e.g., rotary and linear conveyors), article placers (e.g. vacuum puck placers), and transfer devices are well known in the article conveying industry and can be used for the purposes described herein. It is not necessary for an understanding and appreciation of the present methods to provide a detailed explanation of these well-known devices and system.

Various styles and configurations of facemasks that incorporate a nose wire are well known, including flat pleated facemasks, and the present methods may have utility in the production lines for these conventional masks. For illustrative purposes only, aspects of the present method are described herein with reference to a particular type of respirator facemask often referred to in the art as a "duckbill" mask, as illustrated in FIG. 1.

Figure 1:
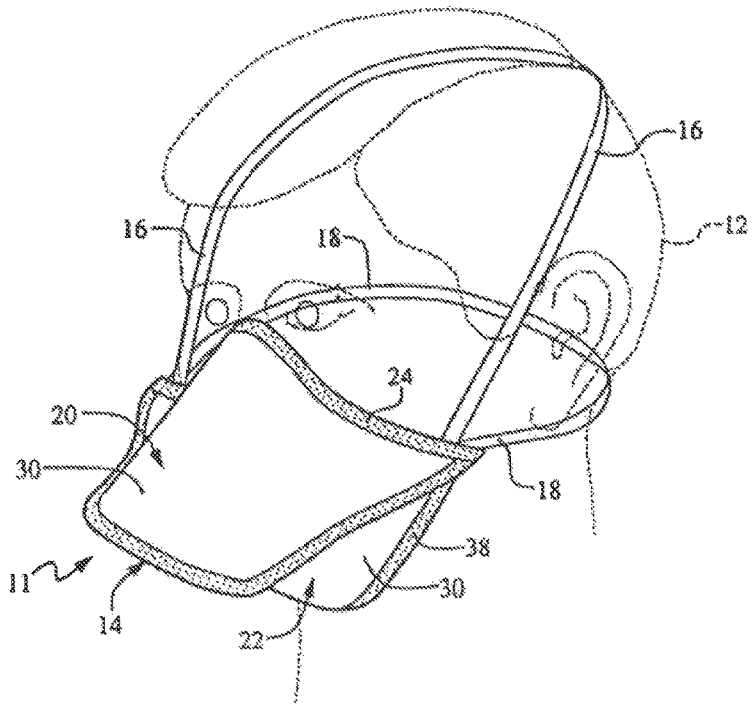
FIG. 1 is a perspective view of a conventional respiratory facemask worn by a user, the facemask incorporating a nose wire to conform the facemask to the user's face.
Figure 2:
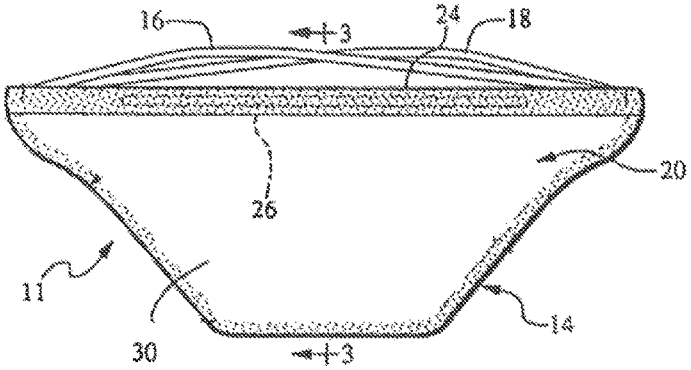
FIG. 2 is a top view of the conventional facemask of FIG. 1 is a folded state.
Figure 3:
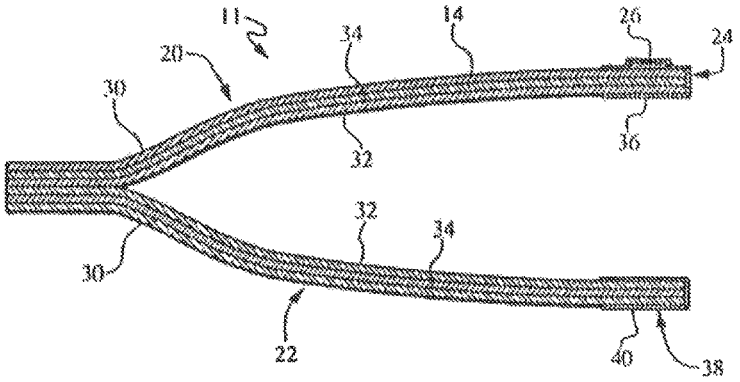
FIG. 3 is a cross-sectional view of the facemask of FIG. 2 taken along the lines indicated in FIG. 2.

Referring to FIGS. 1-3, a representative facemask 11 (e.g., a duckbill facemask) is illustrated on the face of wearer 12. The mask 11 includes filter body 14 that is secured to the wearer 12 by means of resilient and elastic straps or securing members 16 and 18. The filter body 14 includes an upper portion 20 and a lower portion 22, both of which have complimentary trapezoidal shapes and are preferably bonded together such as by heat and/or ultrasonic sealing along three sides. Bonding in this manner adds important structural integrity to mask 11.

The fourth side of the mask 11 is open and includes a top edge 24 and a bottom edge 38, which cooperate with each other to define the periphery of the mask 11 that contacts the wearer's face. The top edge 24 is arranged to receive an elongated malleable member 26 (FIGS. 2 and 3) in the form of a flat metal ribbon or wire (referred to herein as a "nose wire"). The nose wire 26 is provided so that top edge 24 of mask 11 can be configured to closely fit the contours of the nose and cheeks of wearer 12. The nose wire 26 is typically constructed from an aluminum strip with a rectangular cross-section. With the exception of having the nose wire 26 located along top edge 24 of the upper portion 20 of the mask 11, the upper and lower portions 20 and 22 may be identical.

As shown in FIG. 1, the mask 11 has the general shape of a cup or cone when placed on the face of wearer 12 and thus provides "off-the-face" benefits of a molded-cone style mask while still being easy for wearer 12 to carry mask 11 in a pocket prior to use. "Off-the-face" style masks provide a larger breathing chamber as compared to soft, pleated masks which contact a substantial portion of the wearer's face. Therefore, "off-the-face" masks permit cooler and easier breathing.

Blow-by associated with normal breathing of wearer 12 is substantially eliminated by properly selecting the dimension and location of the nose wire 26 with respect to top edge of 24. The nose wire 26 is preferably positioned in the center of top edge 24 and has a length in the range of fifty percent (50%) to seventy percent (70%) of the total length of the top edge 24.

As illustrated in cross-sectional view of FIG. 3, the upper and lower portions 20 and 22 may include multiple layers and each have an outer mask layer 30 and inner mask layer 32. Located between outer and inner mask layers 30, 32 is one or more intermediate layer 34 that comprises the filter media for the mask 11. This layer is typically constructed from a melt-blown polypropylene, extruded polycarbonate, melt-blown polyester, or a melt-blown urethane.

The top edge 24 of the mask 11 is faced with an edge binder 36 that extends across the open end of mask 11 and covers the nose wire 26. Similarly, the bottom edge 38 is encompassed by an edge binder 40. Edge binders 36 and 40 are folded over and bonded to the respective edges 24, 30 after placement of the nose wire 26 along the top edge 24. The edge binders 36, 40 may be constructed from a spun-laced polyester material.

Figure 4:
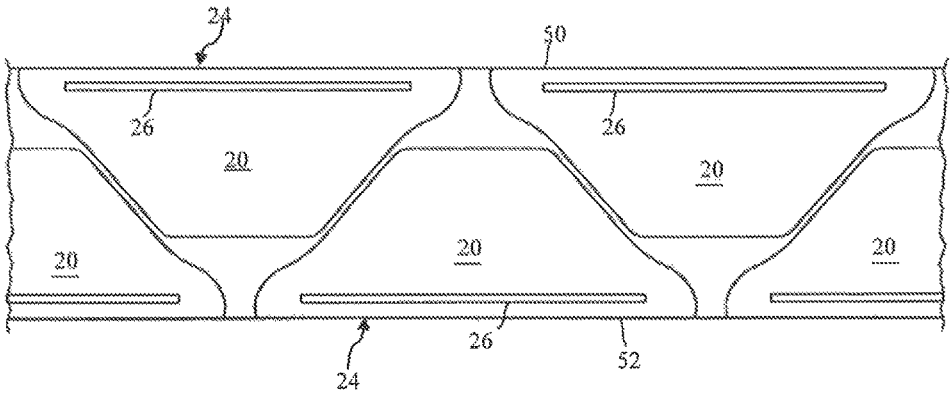
FIG. 4 is a top view of a web having a plurality of facemask panels defined therein, with a nose wire incorporated in edges of alternating panels in the web.

FIG. 4 illustrates the layout of the generally trapezoidal shape for cutting the layers forming the upper body portions 20. A similar layout would be produced for the lower body portion 22, which is then brought into alignment with and bonded to the upper body portion 20 in the facemask manufacturing line. More precisely, the layouts of FIG. 4 represent the outline of cutters which ultimately cut layers 30 and 32 for the upper portion 20 from respective flat sheets of material, with the layouts arranged in an alternating pattern on the flat sheets of material between edges 50, 52 representing the open side of mask 11 formed by top edge 24 and bottom edge 38. The arrangement of the layouts is such that a continuous piece of scrap may be is formed as the material is fed through the cutter (not shown) utilized in making mask 11. FIG. 4 illustrates placement of cut nose wires 26 on the portions of the continuous web corresponding to the top edge 24 prior to folding and bonding of the edge binders 36, 40 along the edges 24, 38.

Figure 5:
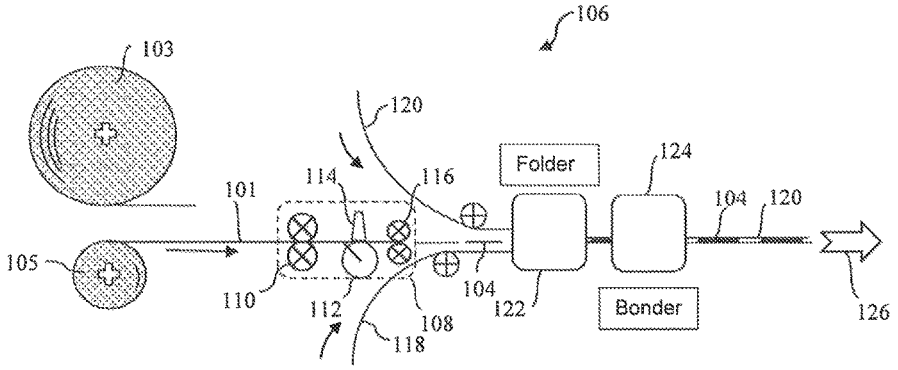
FIG. 5 is a schematic depiction of parts of a facemask production line in accordance with aspects of the invention related to feeding and cutting of nose wires for subsequent incorporation with facemask panels.

FIG. 5 depicts portions of a production line 106 for facemasks that incorporate a nose wire 26. A running nose wire 104 is supplied in continuous strip form from a source, such as a driven operational running roll 130, to a cutting station 108. Suitable cutting stations 108 are known and used in conventional production lines. The station 108 may include a set of feed rollers 110 that define a driven nip, wherein one of the feed rollers is driven and the other may be an idler roll. The feed rollers 110 may also serve to impart a crimped pattern to the running nose wire, such as diamond pattern. The running nose wire is fed to a cutter roller 112 configured opposite to an anvil 114, wherein the cuter roller 112 is driven at a rate so as to cut the running nose wire 104 into individual nose wires 26. Downstream of the cutter roller 112, a pair of delivery rollers 116 transports the individual nose wires 26 from the cutting station 108 onto a carrier web 118. Referring to FIG. 4, this carrier web 118 may be the continuous multi-layer web that defines the upper body portion 20 wherein the individual nose wires 26 are deposited along the edge of the carrier web 118 corresponding to the top edge 24. It should be appreciated that an additional cutting station may be operationally disposed opposite to (and upstream or downstream) of the cutting station 108 for cutting and placing the nose wires on the opposite nested upper body portions 20 in the web depicted in FIG. 4. For the sake of ease of understanding only one such cutting station is illustrated and described herein.

FIG. 5 also depicts staging of a reserve nose wire source 105 proximate to the running first nose wire source 103. Upon a predetermined depletion state of the first nose wire source 105, the reserve nose wire source 103 (and individual nose wires produced therefrom) is introduced to the production line, as explained in greater detail below with reference to FIGS. 6 through 10.

After placement of the individual nose wires 104 in position on the carrier web 118, the binder web 120 is introduced to the production line 106 along both edges of the carrier web 118 (only one binder web 120 is depicted in FIG. 5.). The combination of carrier web 118, nose wire 26, and binder webs 120 pass through a folding station 122 wherein the binder webs 118 are folded around the respective running edges 50, 52 of the carrier web 118 (FIG. 4). The components then pass through a bonding station 124 wherein the binder webs 120 are thermally bonded to the carrier web 118, thereby producing the edge configurations 24, 38 depicted in FIG. 3 with respective binders 36, 40. The nose wire 104 is held in position relative to the top edge 24 by the binder 36.

From the bonding station 124, the continuous combination of carrier web 118 with nose wires 104 under the binder 36 is conveyed to further downstream processing stations 126 wherein the individual facemasks are cut, bonded, head straps are applied, and so forth.

Figure 6:
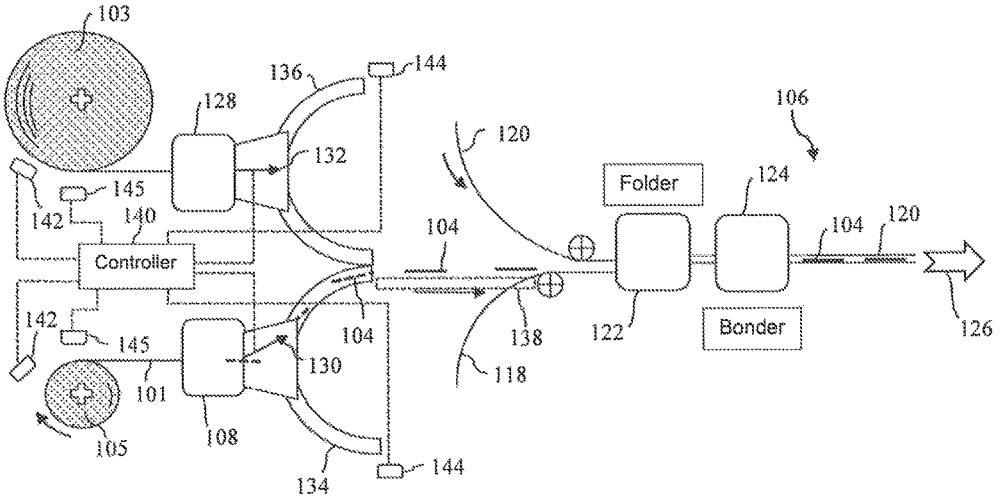
FIG. 6 is a schematic representation of aspects for introducing reserve nose wires from a reserve source into a running production line in accordance with aspects of the invention.

With further reference to FIGS. 6 through 10, aspects of a method 100 are depicted for introducing individual reserve nose wires 102 produced from the reserve nose wire source 103 into the running production line 106. FIG. 6 depicts the reserve nose wire source 103 as a roll staged in a stand-by position. The method includes providing the first nose wire source 103 with a dedicated first cutter system 108 for the production line 106, wherein the running nose wires 104 are supplied by the first nose wire source 105 and first cutter system 108 as described above with reference to FIG. 5. The reserve nose wire source 103 is provided with a dedicated second cutter system 128 also staged in a stand-by state proximate to the first nose wire source 105 and first cutter system 108. The second cutter system 128 may be configured as discussed above with respect to the first cutter system 108, or may be a different cutting system.

Still referring to FIG. 6, each of the cutter systems 108, 128 is configured with a respective controllable diverter 130, 132 that directs the individual nose wires to either an operational direction wherein the nose wires are transported to the production line 106 as the running nose wires 104, or to a discard or reject direction away from the production line. The diverters 130, 132 may be any type of mechanical or pneumatic device that is used to change direction of a flow of articles. Any manner of conveyor(s) may be used to transport the nose wires from the respective diverters 130, 132 to the production line 106 or discard location, as schematically illustrated by the conveyors 134, 136 in FIG. 6 that transport the nose wires to an intermediate transport surface 138, which may be a driven conveyor, roller table, and the like, before they are transported to the folder 122.

FIG. 6 depicts the system wherein the first nose wire source 105 and first cutting system 108 are supplying the individual nose wires 104 to the production line 106, and the reserve nose wire source 103 and second cutting system 128 are in stand-by or ready state.

Figure 7:
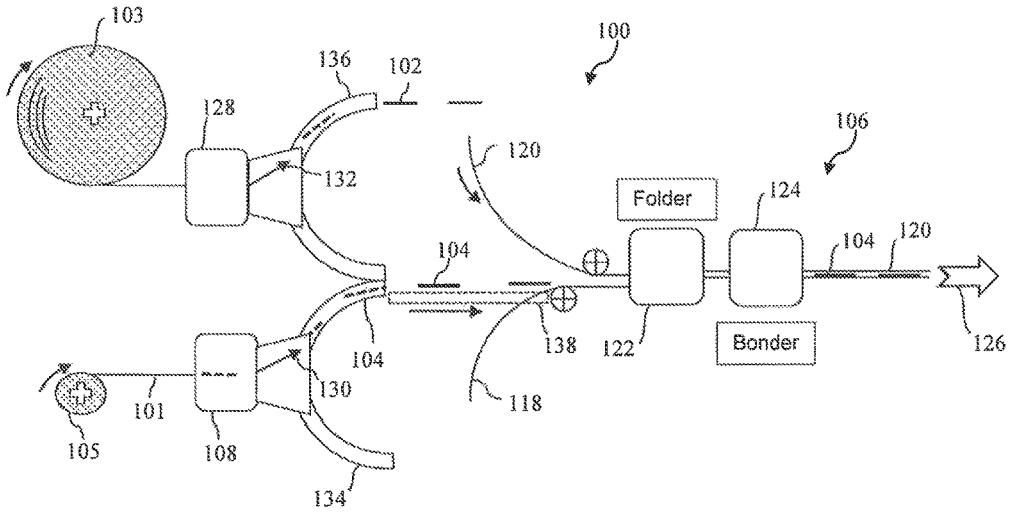
FIG. 7 is a schematic representation of further aspects for introducing reserve nose wires from a reserve source into a running production line in accordance with aspects of the invention.

Referring to FIG. 7, prior to depletion of the first nose wire source 105, the reserve reserve nose wire source 103 and second cutter system 128 are brought up to an operational speed while the nose wires 102 produced by the second cutter system 128 are diverted away from the production line 106, for example to a reject or discard location by the second diverter 132.

Figure 8:
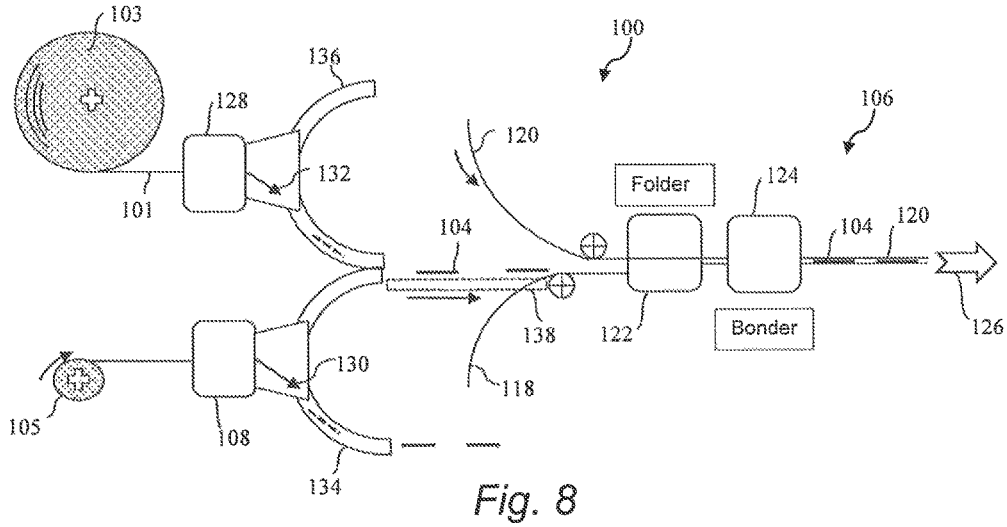
FIG. 8 is a schematic representation of still other aspects for introducing reserve nose wires from a reserve source into a running production line in accordance with aspects of the invention.

Referring to FIG. 8, at a desired operational speed of the reserve nose wire source 103 and second cutter system 128, nose wires from the second cutter system are diverted by the second diverter 132 to the production line 106 and, thus, become the running nose wires 104. At or near the same time, nose wires from the first cutter system 108 are diverted away from the production line 106 by the first diverter 130, for example to the same or a different reject location.

Figure 9:
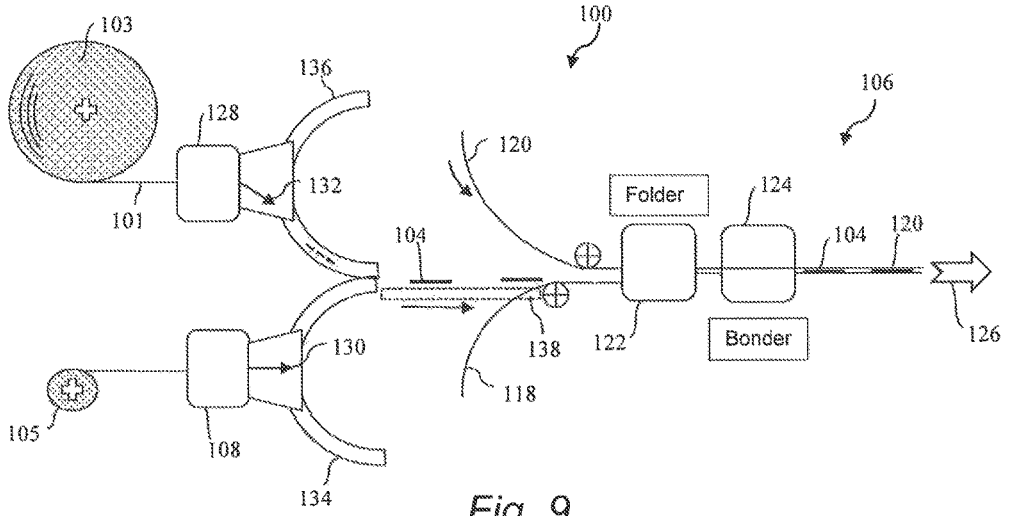
FIG. 9 is another schematic representation of aspects for introducing reserve nose wires from a reserve source into a running production line in accordance with aspects of the invention.

Referring to FIG. 9, after the nose wires from the first cutter system 108 have been diverted away from the production line 106, the method may further include stopping the first nose wire source 105 and first cutting system 108.

Figure 10:
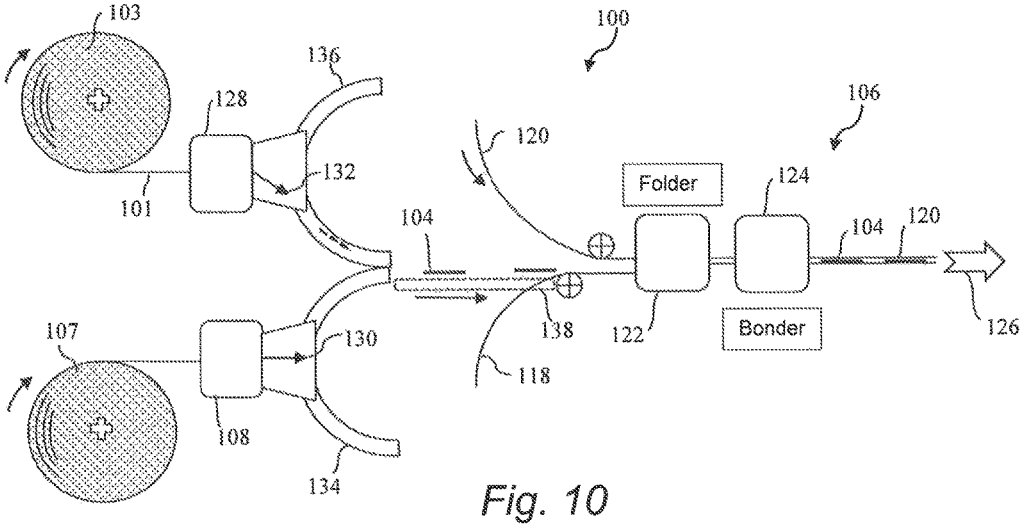
FIG. 10 is a schematic representation of still further aspects for introducing reserve nose wires from a reserve source into a running production line in accordance with aspects of the invention.

Referring to FIG. 10, the "old" nose wire source may be removed and replaced with a new nose wire source 107, wherein the new nose wire source 107 and first cutting system 108 are placed in a stand-by state proximate to the running reserve nose wire source 103. Thus, the new nose wire source 107 becomes a new reserve nose wire source in a subsequent operation of the method.

Referring to FIG. 6, the method 100 may include sensing speed of the reserve nose wire source 103 (e.g., rotational speed) by a speed sensor 142 in communication with a controller 140 to determine when the reserve nose wire source 103 and second cutter system 128 are at operational speed prior to the controller 140 actuating the second diverter 132 to divert the nose wires to the production line 106. A similar speed sensor 142 may be configured at the location of the first nose wire source 105 for the same purpose when the new reserve roll 107 is placed at the location. In an alternate embodiment, a throughput sensor 144 may be disposed at a location to detect and count actual nose wires supplied by the respective cutting systems 108, 128 over a defined time period, wherein this throughput measurement is used to determine when to actuate the diverters 130, 132.

The controller 140 may be any configuration of control hardware and software to perform the functions described herein.

In addition, a depletion state of the first nose wire source 105 may be sensed by a sensor 145, for example by detecting a change in diameter of the roll, for determining when to start bringing the reserve nose wire source 103 and second cutter system up 128 up to the operational speed. A respective depletion state sensor 145 may be disposed at the locations for each of the first nose wire source 105 and reserve nose wire source 103 for the same purpose.

In a particular embodiment, the second cutter system 128 and staging location for the reserve nose wire source 103 are permanent and fixed in the production line 106. In an alternate embodiment, the second cutter system 128 and staging location for the reserve nose wire 103 are portable (e.g., mounted on a carriage) and are moved to the production line 106 at a sensed depletion state of the first nose wire source 105. Similarly, the first cutter system 108 and location for the first nose wire source 105 may be portable and moved between different production lines 106.

As mentioned, the present invention also encompasses various system embodiments for introducing a supply of reserve nose wires in a facemask production line prior to depletion of running nose wires in the production line, in accordance with the present methods. Aspects of such systems are illustrated in the figures, and described and supported above.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A method for introducing a supply of reserve nose wires in a facemask production line prior to depletion of running nose wires in the facemask production line, comprising:

providing a first nose wire source and first cutter system for the facemask production line, the running nose wires supplied by the first nose wire source and first cutter system;

staging a reserve nose wire source and second cutter system in stand-by proximate to the first nose wire source;

prior to depletion of the first nose wire source, bringing the reserve nose wire source and second cutter system up to an operational speed while diverting nose wires from the second cutter system away from the production line; and at operational speed of the reserve nose wire source and second cutter system, diverting nose wires from the second cutter system to the production line while diverting nose wires from the first cutter system away from the production line.

2. The method as in claim 1, further comprising stopping and replacing the first nose wire source with a new nose wire source and placing the new nose wire source and first cutter system in stand-by, wherein the new nose wire source becomes the reserve nose wire source in a subsequent operation of the method.

3. The method as in claim 1, wherein the first nose wire source and reserve nose wire source are rolls of the nose wire that are rotationally driven at the operation speed to supply nose wire to their respective cutter system for the production line.

4. The method as in claim 1, wherein the nose wires from the second cutter system are diverted to a reject location prior to the reserve nose wire source and second cutter system reaching the operational speed.

5. The method as in claim 4, wherein the nose wires from the first cutter system are diverted to a reject location once the nose wires from the second cutter system are diverted to the production line.

6. The method as in claim 1, further comprising sensing one or a combination of speed of the reserve nose wire source or throughput of the second cutter system to determine when the reserve nose wire source and second cutter system are at operational speed.

7. The method as in claim 1, further comprising sensing a depletion state of the first nose wire source for determining when to start bringing the reserve nose wire source and second cutter system up to the operation speed.

8. The method as in claim 1, wherein the second cutter system and staging location for the reserve nose wire are permanent and fixed in the production line.

9. The method as in claim 1, wherein the second cutter system and staging location for the reserve nose wire are portable and are moved to the production line at a sensed depletion state of the first nose wire source.

10. The method as in claim 9, wherein the first cutter system and location for the first nose wire source are portable and moved to the production line.

11. A system for introducing a supply of reserve nose wires in a facemask production line prior to depletion of running nose wires in the facemask production line, wherein the system is specifically configured for practice of the method of claim 1.

* * * * *